US009033448B2

(12) United States Patent
Nishi et al.

(10) Patent No.: US 9,033,448 B2
(45) Date of Patent: May 19, 2015

(54) LIGHTWEIGHT COATED PAPER AND PRINT PRODUCTION METHOD USING THE SAME

(71) Applicant: MITSUBISHI PAPER MILLS LIMITED, Tokyo (JP)

(72) Inventors: Tetsuya Nishi, Tokyo (JP); Koji Idei, Tokyo (JP); Masanori Nagoshi, Tokyo (JP); Toru Kaneko, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 14/376,542

(22) PCT Filed: Jan. 25, 2013

(86) PCT No.: PCT/JP2013/051574
§ 371 (c)(1),
(2) Date: Aug. 4, 2014

(87) PCT Pub. No.: WO2013/121860
PCT Pub. Date: Aug. 22, 2013

(65) Prior Publication Data

US 2015/0049140 A1 Feb. 19, 2015

(30) Foreign Application Priority Data

Feb. 13, 2012 (JP) ..... 2012-028228

(51) Int. Cl.
*B41J 29/38* (2006.01)
*B41J 2/015* (2006.01)
*B41M 5/52* (2006.01)

(52) U.S. Cl.
CPC ..... *B41M 5/5218* (2013.01); *B41M 5/5263* (2013.01); *B41M 5/5227* (2013.01)

(58) Field of Classification Search
USPC ..... 347/16, 20
See application file for complete search history.

(56) References Cited

U.S. PATENT DOCUMENTS

| | | | | |
|---|---|---|---|---|
| 5,616,409 | A | 4/1997 | Matsuda et al. | |
| 2005/0191443 | A1 | 9/2005 | Sunagawa et al. | |
| 2010/0028659 | A1 | 2/2010 | Shimono et al. | |
| 2011/0304661 | A1 * | 12/2011 | Emamjomeh et al. | 347/1 |
| 2012/0107531 | A1 | 5/2012 | Idei et al. | |

FOREIGN PATENT DOCUMENTS

| | | | |
|---|---|---|---|
| JP | 3-43290 | A | 2/1991 |
| JP | 5-254239 | A | 10/1993 |
| JP | 9-290556 | A | 11/1997 |
| JP | 2004-114627 | A | 4/2004 |
| JP | 2005-231146 | A | 9/2005 |
| JP | 2005-231268 | A | 9/2005 |
| JP | 2005-290579 | A | 10/2005 |
| JP | 2008-97373 | A | 4/2008 |
| WO | WO 2008/041715 | A1 | 4/2008 |
| WO | WO 2011/001955 | A1 | 1/2011 |

* cited by examiner

*Primary Examiner* — Jason Uhlenhake
(74) *Attorney, Agent, or Firm* — Birch, Stewart, Kolasch & Birch, LLP

(57) ABSTRACT

The invention provides lightweight coated paper having good offset printability. The invention provides lightweight coated paper having good printability in commercial printing utilizing the ink jet recording system. The lightweight coated paper of the invention includes base paper, and one or more coating layers disposed on at least one side of the base paper. The coating layer includes a pigment and a binder. The total coating weight of the coating layer(s) is not more than 7.5 g/m$^2$ per side of the base paper. The coating layer contains a polycondensate of an aliphatic monoamine or an aliphatic polyamine and an epihalohydrin compound, and a water-soluble polyvalent cation salt. The content of the water-soluble polyvalent cation salt in the coating layer is 0.3 g/m$^2$ to 1.0 g/m$^2$ per side of the base paper. The content of the polycondensate of an aliphatic monoamine or an aliphatic polyamine and an epihalohydrin compound in the coating layer is 15 mass % to less than 100 mass % relative to the content of the water-soluble polyvalent cation salt.

10 Claims, No Drawings

LIGHTWEIGHT COATED PAPER AND PRINT PRODUCTION METHOD USING THE SAME

TECHNICAL FIELD

The present invention relates to lightweight coated paper suited for printing on offset printing machines and ink jet printing machines used in the commercial printing field. Further, the invention relates to a method for producing prints with the lightweight coated paper on an ink jet printing machine.

BACKGROUND ART

The speed and the size of the ink jet recording system have been increased in recent years, and the ink jet recording system has come to be used in commercial printing (hereinafter, written as "ink jet printing"). Industrial printing machines based on the ink jet recording system that are used in commercial printing (hereinafter, written as "ink jet printing machines") have been developed (see, for example, Patent Literature 1). Because large numbers of copies are printed in the commercial printing field, the printing speed is important due to the tradeoff between productivity and printing costs. The printing speed is 15 m/min or above, and is often 60 m/min or above. For higher speed printing, rotary pigmented ink jet printing machines have been developed which are capable of a printing speed exceeding 120 m/min.

Because the ink jet printing machines allow for handling of variable information, their use is particularly found in on-demand printing. A preferred manner of commercial printing is to print fixed information on an offset printing machine and to print variable information on an ink jet printing machine.

The printing paper used for ink jet printing machines is coated paper, plain paper such as wood free paper for so-called offset printing, or PPC paper. In the field of commercial printing such as invoices, account statements, leaflets, direct mails and so-called TransPromo (transaction and promotion) that is the combination of these printed matters, there is recently a trend for higher image quality and consequently data usually printed on plain paper are increasingly printed on coated paper. When, however, inks are printed on the conventional plain paper or coated paper for offset printing with an ink jet printing machine at the above printing speed, the inks exhibit poor fixation on the printing paper to cause problems such as uneven drying of the inks, and images being contaminated with the inks. In a worse case, marks are left by the flowing of inks (the inks sitting on the paper run on the surface). Further, the printed images are smudged during the handling of the printed paper.

There are two types of ink jet inks used on ink jet printing machines: dye inks that are solutions of color materials in solvents such as water, and pigmented inks that are dispersions of color materials in solvents such as water. The dye inks outperform the pigmented inks in the sharpness of images, but tend to compare unfavorably in terms of the weather resistance of images. The color materials in the dye inks are fixed by being absorbed into the printing paper, whilst the color materials in the pigmented inks are fixed through adhesion to the surface of the printing paper. For both types of the inks, it is important that water as the solvent be quickly absorbed to allow the color materials to dry. That is, ink fixing properties are of importance. With the dye inks, it is also important that the color materials be prevented from being redissolved in the solvents or moisture in the air. In the case of the pigmented inks, strong adhesion of the color materials to the surface of printing paper is critical. Insufficient ink fixing properties cause the occurrence of phenomena such as contamination of prints with the inks. In addition, insufficient fixation of the dye inks causes the occurrence of problems such as the bleeding of images due to the redissohition of color materials, and also beading, thus decreasing sharpness. In the case of the pigmented inks, insufficient adhesion of the color materials decreases rubbing resistance, resulting in problems such as chalking and smudges.

Ink jet recording paper that has a coating layer containing a porous pigment is a known technique for improving the absorptivity with respect to ink jet inks (see, for example, Patent Literatures 2 and 3). To improve the printability with dye inks and pigmented inks, ink jet recording sheets are known that have an ink receiving layer containing a styrene-acrylic copolymer resin, a guanidine compound as a cationic polymer, and a secondary ammonium salt compound. Other ink jet recording sheets are also known which have an ink receiving layer containing at least one of zinc oxide, zinc sulfate, magnesium chloride and magnesium sulfate, and a guanidine compound. Further, ink jet recording media are known which are coated with a coating color including an aqueous emulsion that is obtained by copolymerizing two or more kinds of monomers including an aromatic vinyl monomer and a conjugated diene monomer in the presence of a water-soluble polymer having an alcoholic hydroxyl group. (See, for example, Patent Literatures 4 to 6.)

CITATION LIST

Patent Literature

Patent Literature 1: Japanese Patent Application Kokai Publication No. 2008-97373

Patent Literature 2: Japanese Patent Application Kokai Publication No. 113-43290

Patent Literature 3: Japanese Patent Application Kokai Publication No. H5-254239

Patent Literature 4: Japanese Patent Application Kokai Publication No. 2005-231146

Patent Literature 5: Japanese Patent Application Kokai Publication No. 2005-231268

Patent Literature 6: Japanese Patent Application Kokai Publication No. 2005-290579

DISCLOSURE OF INVENTION

Technical Problem

The ink jet recording papers described in Patent Literatures 2 to 6 achieve improvements in absorptivity or printability with dye inks and pigmented inks. The ink jet recording papers or sheets described in Patent Literatures 2 to 6 show printability only with so-called ink jet printers for use in home or office, and there is no printability with offset printing machines and ink jet printing machines. In these ink jet recording papers or sheets, the coating layers containing a porous pigment do not sometimes have coating layer strength enough to withstand offset printing, and consequently can cause blanket piling. Further, these ink jet recording papers or sheets are not fully satisfactory in terms of ink fixing properties in order to meet a printing speed used in ink jet printing; and also in terms of the sharpness of dye inks and the rubbing resistance of pigmented inks.

To respond to demands for higher quality of printed images, the commercial printing industry tends to prefer coated paper to plain paper. On the other hand, printing companies tend to prefer lightweight coated paper with less coating in order to reduce paper costs. Lightweight coated paper is a type of coated paper having a total coating weight on both sides of not more than 15 g/m$^2$. Such a low coating weight makes it difficult for the lightweight coated paper to satisfy ink fixing properties, the sharpness of dye inks and the rubbing resistance of pigmented inks when used in printing on an ink jet printing machine. In particular, the enhancement in image quality of color-mixing halftone dot images such as pictures created by combinations of various color inks has led to a higher level of improvements of coated paper in terms of the ink fixing properties conforming to high ink jet printing speed, the sharpness of dye inks and the rubbing resistance of pigmented inks.

An object (1) of the invention is to provide lightweight coated paper which has good offset printability and realizes excellent ink fixing properties, excellent sharpness of dye inks and high rubbing resistance of pigmented inks when used in printing on an ink jet printing machine. Another object (2) of the invention is to provide a method for producing a print having excellent ink fixation, excellent sharpness of dye inks and excellent rubbing resistance of pigmented inks, with use of lightweight coated paper on an ink jet printing machine.

Solution to Problem

The object (1) of the invention may be achieved by the following aspect of the invention:

lightweight coated paper including base paper, and one or more coating layers disposed on at least one side of the base paper, the coating layer including a pigment and a binder, the total coating weight of the coating layer(s) being not more than 7.5 g/m$^2$ per side of the base paper, the coating layer containing a polycondensate of an aliphatic monoamine or an aliphatic polyamine and an epihalohydrin compound, and a water-soluble polyvalent cation salt, the content of the water-soluble polyvalent cation salt in the coating layer being 0.3 g/m$^2$ to 1.0 g/m$^2$ per side of the base paper, the content of the polycondensate of an aliphatic monoamine or an aliphatic polyamine and an epihalohydrin compound in the coating layer being 15 mass % to less than 100 mass % relative to the content of the water-soluble polyvalent cation salt.

According to the present invention, lightweight coated paper may be provided which exhibits good offset printability and shows good printability in ink jet printing with both dye inks and pigmented inks.

A preferred embodiment of the invention resides in:

lightweight coated paper including base paper, and one or more coating layers disposed on at least one side of the base paper, the coating layer including a pigment and a binder, the total coating weight of the coating layer(s) being not more than 7.5 g/m$^2$ per side of the base paper, the coating layer containing a polycondensate of an aliphatic monoamine or an aliphatic polyamine and an epihalohydrin compound, and a water-soluble calcium salt, the content of the water-soluble calcium salt in the coating layer being 0.3 g/m$^2$ to 1.0 g/m$^2$ per side of the base paper, the content of the polycondensate of an aliphatic monoamine or an aliphatic polyamine and an epihalohydrin compound in the coating layer being 15 mass % to less than 100 mass % relative to the content of the water-soluble calcium salt.

According to the preferred embodiment of the present invention, lightweight coated paper may be provided which achieves higher printability in ink jet printing with both dye inks and pigmented inks.

A further preferred embodiment of the invention resides in:

lightweight coated paper including base paper, and one or more coating layers disposed on at least one side of the base paper, the coating layer including a pigment and a binder, the total coating weight of the coating layer(s) being not more than 7.5 g/m$^2$ per side of the base paper, the coating layer containing a polycondensate of an aliphatic monoamine or an aliphatic polyamine and an epihalohydrin compound, and calcium chloride or calcium nitrate, the content of the calcium chloride or calcium nitrate in the coating layer being 0.3 g/m$^2$ to 1.0 g/m$^2$ per side of the base paper, the content of the polycondensate of an aliphatic monoamine or an aliphatic polyamine and an epihalohydrin compound in the coating layer being 15 mass % to less than 100 mass % relative to the content of the calcium chloride or calcium nitrate.

According to the further preferred embodiment of the present invention, lightweight coated paper may be provided which achieves still higher printability in ink jet printing with both dye inks and pigmented inks.

In the invention, it is preferable that the coating layer at least contain, as the pigment, aragonite precipitated calcium carbonate having a longer diameter of 1.5 μm to 4 μm and a longer diameter/shorter diameter ratio of 8 to 20, and the content of the aragonite precipitated calcium carbonate in the coating layer be not less than 40 mass % per side of the base paper relative to the total amount of the pigment(s) present in the coating layer.

With this configuration, the lightweight coated paper exhibits still higher offset printability and shows still higher printability in ink jet printing with both dye inks and pigmented inks.

The object (2) of the invention may be achieved by the following aspect of the invention:

a print production method including a step of printing an ink on any of the inventive lightweight coated papers with an ink jet printing machine at a printing speed of not less than 60 m/min.

According to the print production method of the invention, prints having excellent ink fixation, excellent sharpness of dye inks and excellent rubbing resistance of pigmented inks may be produced.

BEST MODE FOR CARRYING OUT INVENTION

Hereinbelow, the lightweight coated papers of the invention will be described in detail.

The lightweight coated papers of the invention include base paper, and one or more coating layers disposed on at least one side of the base paper. The coating layer includes a pigment and a binder. The total coating weight of the coating layer(s) is not more than 7.5 g/m$^2$ per side of the base paper. When the coating layers are disposed on both sides of the base paper, the total coating weight on both sides is not more than 15 g/m$^2$. The coating layers disposed on the base paper provide higher image quality in offset printing and ink jet printing than obtained when plain paper is used.

In the invention, the lightweight coated paper includes a coating layer(s). The coating layer contains a polycondensate of an aliphatic monoamine or an aliphatic polyamine and an epihalohydrin compound, and a water-soluble polyvalent cation salt. The content of the water-soluble polyvalent cation salt in the coating layer is 0.3 g/m$^2$ to 1.0 g/m$^2$ per side of the base paper. The content of the polycondensate of an aliphatic monoamine or an aliphatic polyamine and an epihalohydrin compound in the coating layer is 15 mass % to less than 100 mass % relative to the content of the water-soluble polyvalent cation salt. If the content of the water-soluble polyvalent cation salt is less than 0.3 g/m$^2$, the rubbing resistance of pigmented inks is deteriorated. Any content of the water-soluble polyvalent cation salt exceeding 1.0 g/m$^2$ not only results in poor sharpness of dye inks but also induces discoloration after printing. Poor sharpness of dye inks is caused if the content of the polycondensate of an aliphatic monoamine or an aliphatic polyamine and an epihalohydrin compound is less than 15 mass % relative to the content of the water-soluble polyvalent cation salt. Ink fixing properties are deteriorated if the content of the polycondensate of an aliphatic monoamine or an aliphatic polyamine and an epihalohydrin compound is 100 mass % or more relative to the content of the water-soluble polyvalent cation salt. The inventive lightweight coated papers can show more advantageous effects by virtue of the satisfaction of the above relationship between the contents of the water-soluble polyvalent cation salt and of the polycondensate of an aliphatic monoamine or an aliphatic polyamine and an epihalohydrin compound.

In the invention, the water-soluble polyvalent cation salt refers to a salt which can be dissolved in 20° C. water at 1 mass % or more and contains a polyvalent cation. Examples of the polyvalent cations include divalent cations such as magnesium, calcium, strontium, barium, nickel, zinc, copper, iron, cobalt, tin and manganese, trivalent cations such as aluminum, iron and chromium, tetravalent cations such as titanium and zirconium, and complex ions of these ions. The anion that forms the salt with the polyvalent cation may be any of inorganic acids and organic acids without limitation. Examples of the inorganic acids include, but are not limited to, hydrochloric acid, nitric acid, phosphoric acid, sulfuric acid, boric acid and hydrofluoric acid. Examples of the organic acids include, but are not limited to, formic acid, acetic acid, lactic acid, citric acid, oxalic acid, succinic acid and organic sulfonic acid. Preferred water-soluble polyvalent cation salts are calcium salts such as calcium chloride, calcium formate, calcium nitrate and calcium acetate.

Calcium salts are preferable as the water-soluble polyvalent cation salts because they do not cause a decrease in layer strength of the coating layers or a decrease in offset printability. Another reason why calcium salts are preferable as the water-soluble polyvalent cation salts is because the use thereof results in enhancements of offset printability and ink fixing properties in ink jet printing when the pigment(s) present in the coating layers includes calcium carbonate. In terms of the rubbing resistance of pigmented inks, the most preferred water-soluble polyvalent cation salts are calcium chloride and calcium nitrate.

In the invention, the polycondensate of an aliphatic monoamine or an aliphatic polyamine and an epihalohydrin compound is a cationic resin in the form of a polycondensate between one or more selected from aliphatic monoamines and aliphatic polyamines, and one or more selected from epihalohydrin compounds. Examples of the aliphatic monoamines include monomethylamine, monoethylamine, dimethylamine, diethylamine, trimethylamine, triethylamine, and mono-, di- or triethanolamine. Examples of the aliphatic polyamines include ethylenediamine, diethylenetriamine, triethylenetetramine, pentaethylenehexamine, metaxylenediamine, hexamethylenediamine, dimethylaminoethylamine, dimethylaminopropylamine and 1,3-diaminobutane. Examples of the epihalohydrin compounds include epichlorohydrin, epibromohydrin, methylepichlorohydrin and methylepibromohydrin. In view of high availability in the market, the polycondensate of an aliphatic monoamine or an aliphatic polyamine and an epihalohydrin compound is preferably dimethylamine-epichlorohydrin polycondensate. In the invention, the number average molecular weight of the polycondensate of an aliphatic monoamine or an aliphatic polyamine and an epihalohydrin compound is not particularly limited, but is preferably 500 to 20,000, and is more preferably 1,000 to 10,000.

It is preferable that the coating layer at least contain calcium carbonate as the pigment. When the water-soluble polyvalent cation salt present in the coating layer is a calcium salt, the use of calcium carbonate as a pigment in the coating layer enhances offset printability and ink fixing properties in ink jet printing. The reason for this enhancement is probably some interaction between the calcium carbonate and the calcium ions derived from the calcium salt.

It is more preferable that the coating layer at least contain, as the pigment, ground calcium carbonate, or aragonite precipitated calcium carbonate having a longer diameter of 1.5 μm to 4 μm and a longer diameter/shorter diameter ratio of 8 to 20. In terms of ink fixing properties on an ink jet printing machine, aragonite precipitated calcium carbonate having a longer diameter of 1.5 μm to 4 μm and a longer diameter/shorter diameter ratio of 8 to 20 is particularly preferable.

In the invention, the content of the aragonite precipitated calcium carbonate in the coating layer is preferably not less than 40 mass % per side of the base paper relative to the total amount of the pigment(s) present in the coating layer.

Calcium carbonate has three types of crystal forms: calcite, aragonite and vaterite. The aragonite crystal has a different coordination number from the other two types of calcium carbonate, namely, the calcite crystal and the vaterite crystal, and has a larger specific gravity and a higher Mohs hardness. Because of these structural differences, the aragonite calcium carbonate, which falls in the category of calcium carbonate, probably shows chemical properties similar to those of strontium carbonate or barium carbonate having a larger cation radius.

The aragonite precipitated calcium carbonate may be produced as follows.

Carbon dioxide is blown into a suspension containing calcium hydroxide to allow the calcium hydroxide to react with the carbon dioxide. Acicular, columnar or other form of particles are produced by controlling the suspension concentration, the reaction temperature, the pH, the carbon dioxide blowing rate, and the stirring rate. For example, the aragonite precipitated calcium carbonate may be synthesized by a method described in Japanese Patent Application Kokai Publication No. 2008-273761. Alternatively, acicular, columnar or other form of aragonite precipitated calcium carbonate having a longer diameter and a longer diameter/shorter diameter ratio in the inventive ranges may be purchased from, for example, OKUTAMA KOGYO CO., LTD.

In an embodiment of the invention, the aragonite precipitated calcium carbonate has a longer diameter of 1.5 μm to 4 μm and a longer diameter/shorter diameter ratio of 8 to 20, and the content of the aragonite precipitated calcium carbonate in the coating layer is not less than 40 mass % per side of the base paper relative to the total amount of the pigment(s) present in the coating layer. This content may be confirmed by observation with a scanning electron microscope. For example, a photograph of the coating layer may be obtained with a scanning electron microscope, and the shapes of 100 pigment particles present in the photograph may be measured to determine the content of the aragonite precipitated calcium carbonate relative to the 100 pigment particles identified in the shape measurement.

In the invention, the coating layer may contain known pigments in addition to the calcium carbonate. Examples of such pigments include inorganic pigments such as kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, aluminum hydroxide, alumina, lithopone, zeolite, magnesium carbonate and magnesium hydroxide; and organic pigments such as styrenic plastic pigments, acrylic plastic pigments, styrene-acrylic plastic pigments, polyethylenes, microcapsules, urea resins and melamine resins.

When a plurality of coating layers are disposed on one side of the base paper, it is preferable that the content of calcium carbonate in the outermost coating layer be not less than 50 mass % relative to the total amount of the pigment(s) present in the outermost coating layer. Such an outermost coating layer containing 50 mass % or more calcium carbonate advantageously exhibits good offset printability. It is also preferable that the content of a porous pigment with a BET specific surface area of not less than 150 $m^2/g$ that is present in the coating layer be not more than 25 mass % relative to the total amount of the pigment(s) present in the coating layer per side of the base paper. Good offset printability may be obtained when the coating layer contains a porous pigment with a BET specific surface area of not less than 150 $m^2/g$ in a content of not more than 25 mass %.

The coating layer includes a binder, which may be any of known water-dispersible binders or water-soluble binders. Examples of the water-dispersible binders include conjugated diene copolymer latexes such as styrene-butadiene copolymer and acrylonitrile-butadiene copolymer; acrylic copolymer latexes such as polymers of acrylate esters or methacrylate esters, and methyl methacrylate-butadiene copolymer; vinyl copolymer latexes such as ethylene-vinyl acetate copolymer and vinyl chloride-vinyl acetate copolymer; polyurethane resin latexes; alkyd resin latexes; unsaturated polyester resin latexes; copolymer latexes in which these various copolymers have been modified with monomers containing a functional group such as a carboxyl group; and thermosetting synthetic resins such as melamine resins and urea resins. Examples of the water-soluble binders include starch derivatives such as starch oxides, starch ethers and starch phosphate esters; cellulose derivatives such as methylcellulose, carboxymethylcellulose and hydroxyethylcellulose; polyvinyl alcohol derivatives such as polyvinyl alcohol and silanol-modified polyvinyl alcohol; natural polymer resins such as casein, gelatin, modified products thereof, soy protein, pullulan, gum arabic, karaya gum, albumin and derivatives thereof, vinyl polymers such as polysodium acrylate, polyacrylamide and polyvinylpyrrolidone; and sodium alginate, polypropylene glycol, polyethylene glycol, maleic acid anhydride and copolymers thereof. The binders are not limited to the above compounds.

The methods for applying the coating layers are not particularly limited. Exemplary applicators include air knife coaters, various blade coaters such as rod blade coaters, roll coaters, bar coaters and curtain coaters. Preferred applicators are various blade coaters or film transfer coaters suited for high speed production, and film transfer coaters are particularly preferable.

The base paper may be paper produced by acid, acid-free or alkaline papermaking of a paper stock which includes chemical pulp, mechanical pulp or waste paper pulp, and a filler such as calcium carbonate and optional additives. Examples of the chemical pulp include LBKP (Leaf Bleached Kraft Pulp) and NBKP (Needle Bleached Kraft Pulp). Examples of the mechanical pulp include GP (Groundwood Pulp), PGW (Pressure GroundWood pulp), RMP (Refiner Mechanical Pulp), TMP (ThermoMechanical Pulp), CTMP (ChemiThermoMechanical Pulp), CMP (ChemiMechanical Pulp) and CGP (Chemi-Groundwood Pulp). Examples of the waste paper pulp include DIP (Delnked Pulp). Examples of the additives include sizing agents, retention aids, cationic compounds, pigment dispersants, thickeners, fluidity improvers, defoamers, antifoamers, release agents, foaming agents, penetrants, coloring dyes, coloring pigments, optical brighteners, UV absorbents, antioxidants, preservatives, fungicides, water resistant additives, wet paper strengthening agents and dry paper strengthening agents.

The sizing degree of the base paper may be any sizing degree as long as the desired effects of the invention are achieved. The sizing degree may be controlled by controlling the amount of an internal sizing agent or the amount of a surface sizing agent applied onto the base paper. Examples of the internal sizing agents include rosin sizing agents, alkenyl succinic acid anhydrides, alkyl ketene dimers, neutral rosin sizing agents and cationic styrene-acrylic sizing agents. Examples of the surface sizing agents include styrene-acrylic sizing agents, olefin sizing agents and styrene-maleic sizing agents.

In the invention, the lightweight coated paper may be used after the drying of the coating layers. Where necessary, the lightweight coated paper may be subjected to calendering with a calender such as a machine calender, a soft nip calender, a super calender, a multistage calender or a multinip calender. Through calendering, the surface of the lightweight coated paper may be smoothed.

However, excessive calendering for the purpose of smoothing will collapse the spaces in the coating layers and will consequently deteriorate the ink fixing properties of the lightweight coated paper in ink jet printing. Thus, calendering is preferably performed to an appropriate degree.

In the invention, the coating layers may be provided on both sides of the base paper. With the coating layers disposed on both sides of the base paper, double side printing on the lightweight coated paper is feasible depending on the type of the printing machine.

The coating layers may be formed by application on the surface of the base paper. The base paper to be coated may be calendered base paper. To adjust the smoothness of the base paper, an undercoat layer may be disposed between the coating layer and the base paper as required.

The final lightweight coated paper is processed into sheets or rolls as products of various sizes in accordance with use purposes. For the storage of products, the products are preferably packed to prevent moisture absorption. The basis weight of the products is not particularly limited, but is preferably 40 $g/m^2$ to 130 $g/m^2$ in the field of commercial printing such as invoices, account statements, leaflets, direct mails and so-called TransPromo that is the combination of these printed matters.

Images are printed on the lightweight coated papers of the invention with use of an ink jet printing machine, thereby producing prints having good image quality for commercial printing. The printing speed of the ink jet printing machine that is used is preferably not less than 15 m/min, more preferably not less than 60 m/min, and still more preferably not less than 120 m/min in light of productivity in commercial printing.

Images may be printed on the inventive coated printing papers with use of an offset printing machine or an ink jet printing machine. Thus, there may be provided a method for forming high-quality print images for commercial printing.

The lightweight coated papers of the invention may be applied to known printing techniques such as offset printing, gravure printing, and wet and dry electrophotography. The lightweight coated papers of the invention may be applied to ink jet printing machines and commercially available ink jet printers. The applications of the inventive lightweight coated papers are not limited to the above.

EXAMPLES

Hereinbelow, the present invention will be described in greater detail based on Examples. The scope of the invention is not limited to such Examples without departing from the spirit of the invention. In the following Examples, "part(s) by mass" and "mass %" indicate part(s) by mass and mass % of dry solids or components on real content. The "coating weight" indicates the weight of the coating on dry solid basis.

(Production of Base Paper)

To a pulp slurry which contained 100 parts by mass of LBKP having a freeness of 400 mlcsf were added 12 parts by mass of precipitated calcium carbonate as a filler, 0.8 parts by mass of amphoteric starch, 0.8 parts by mass of aluminum sulfate and 1.0 part by mass of an alkyl ketene dimer sizing agent (Sizepine K903, manufactured by Arakawa Chemical Industries, Ltd.). Next, the pulp slurry was supplied to a Fourdrinier machine to form paper. With a size press, starch oxide was applied to both sides of the paper in an amount of 3.0 g/m$^2$. The paper was then subjected to machine calendering to give base paper having a basis weight of 100 g/m$^2$. The ash content in the base paper was 10 mass %.

<Preparation of Coating Colors for Production of Coating Layers>

Coating colors for the production of coating layers were prepared by mixing the following components together.

Calcium carbonates Types and amounts are described in Tables 1 to 4.

Kaolin Amounts are described in Tables 1 to 4.

Polyvinyl alcohol 10 Parts by mass.

Starch phosphate ester 10 Parts by mass.

Water-soluble cation salts Types and amounts are described in Tables 1 to 4.

Cationic resins Types and amounts are described in Tables 1 to 4.

The above components were mixed together and dispersed in water. The solid concentrations of the coating colors were controlled to 40 mass %.

TABLE 1

| | Pigments | | | | | | | |
|---|---|---|---|---|---|---|---|---|
| | | Precipitated calcium carbonate | | | | | | |
| | Ground calcium carbonate Parts by mass | Type of crystal | Longer diameter μm | Longer diameter/shorter diameter ratio | Parts by mass | Kaolin Parts by mass | Water-soluble cation salt Type | Water-soluble cation salt Parts by mass |
| Ex. 1 | 100 | — | — | — | 0 | 0 | Calcium chloride | 8.8 |
| Ex. 2 | 100 | — | — | — | 0 | 0 | Calcium chloride | 8.8 |
| Ex. 3 | 100 | — | — | — | 0 | 0 | Calcium chloride | 25.6 |
| Ex. 4 | 100 | — | — | — | 0 | 0 | Calcium chloride | 35.7 |
| Ex. 5 | 100 | — | — | — | 0 | 0 | Calcium nitrate | 8.8 |
| Ex. 6 | 100 | — | — | — | 0 | 0 | Calcium nitrate | 25.6 |
| Ex. 7 | 100 | — | — | — | 0 | 0 | calcium nitrate | 35.7 |
| Ex. 8 | 100 | — | — | — | 0 | 0 | Calcium formate | 8.8 |
| Ex. 9 | 100 | — | — | — | 0 | 0 | Calcium formate | 25.6 |
| Ex. 10 | 100 | — | — | — | 0 | 0 | Calcium formate | 35.7 |
| Ex. 11 | 100 | — | — | — | 0 | 0 | Magnesium chloride | 8.8 |
| Ex. 12 | 100 | — | — | — | 0 | 0 | Magnesium chloride | 25.7 |

| | Cationic resin | | Coating weight | Offset | Ink jet printing | | | |
|---|---|---|---|---|---|---|---|---|
| | | | | | Dye inks | | Pigmented inks | |
| | Type | Parts by mass | (per side) g/m$^2$ | printability | Ink fixing properties | Sharpness | Ink fixing properties | Rubbing resistance |
| Ex. 1 | Dimethylamine-epichlorohydrin polycondensate | 1.4 | 4.5 | 5 | 4 | 5 | 5 | 5 |
| Ex. 2 | Dimethylamine-epichlorohydrin polycondensate | 1.4 | 7.5 | 5 | 4 | 5 | 5 | 5 |
| Ex. 3 | Dimethylamine-epichlorohydrin polycondensate | 4.1 | 4.5 | 5 | 4 | 5 | 5 | 5 |
| Ex. 4 | Dimethylamine-epichlorohydrin polycondensate | 5.7 | 4.5 | 5 | 4 | 4 | 5 | 5 |

TABLE 1-continued

| | | | | | | | | |
|---|---|---|---|---|---|---|---|---|
| Ex. 5 | Dimethylamine-epichlorohydrin polycondensate | 1.4 | 4.5 | 5 | 4 | 5 | 5 | 5 |
| Ex. 6 | Dimethylamine-epichlorohydrin polycondensate | 4.1 | 4.5 | 5 | 4 | 5 | 5 | 5 |
| Ex. 7 | Dimethylamine-epichlorohydrin polycondensate | 5.7 | 4.5 | 5 | 4 | 5 | 5 | 5 |
| Ex. 8 | Dimethylamine-epichlorohydrin polycondensate | 1.4 | 4.5 | 5 | 4 | 5 | 5 | 4 |
| Ex. 9 | Dimethylamine-epichlorohydrin polycondensate | 4.1 | 4.5 | 5 | 4 | 5 | 5 | 4 |
| Ex. 10 | Dimethylamine-epichlorohydrin polycondensate | 5.7 | 4.5 | 5 | 4 | 5 | 5 | 4 |
| Ex. 11 | Dimethylamine-epichlorohydrin polycondensate | 1.4 | 4.5 | 4 | 4 | 4 | 3 | 3 |
| Ex. 12 | Dimethylamine-epichlorohydrin polycondensate | 4.1 | 4.5 | 4 | 4 | 4 | 3 | 3 |

TABLE 2

| | Pigments | | | | | | | |
|---|---|---|---|---|---|---|---|---|
| | | Precipitated calcium carbonate | | | | | | |
| | Ground calcium carbonate | | Longer | Longer diameter/ shorter | | Kaolin | Water-soluble cation salt | |
| | Parts by mass | Type of crystal | diameter μm | diameter ratio | Parts by mass | Parts by mass | Type | Parts by mass |
| Ex. 13 | 100 | — | — | — | 0 | 0 | Magnesium chloride | 35.7 |
| Ex. 14 | 40 | — | — | — | 0 | 60 | Calcium chloride | 25.6 |
| Ex. 15 | 50 | — | — | — | 0 | 50 | Calcium chloride | 25.6 |
| Ex. 16 | 75 | — | — | — | 0 | 25 | Calcium chloride | 25.6 |
| Ex. 17 | 0 | — | — | — | 0 | 100 | Calcium chloride | 25.6 |
| Ex. 18 | 0 | Calcite | 2.0 | 3.3 | 100 | 0 | Calcium chloride | 25.6 |
| Ex. 19 | 0 | Calcite | 2.0 | 3.3 | 75 | 25 | Calcium chloride | 25.6 |
| Ex. 20 | 0 | Calcite | 0.6 | 1.2 | 75 | 25 | Calcium chloride | 25.6 |
| Ex. 21 | 0 | Calcite | 0.6 | 1.2 | 75 | 25 | Calcium chloride | 25.6 |
| Ex. 22 | 0 | Aragonite | 2.0 | 10.0 | 100 | 0 | Calcium chloride | 25.6 |
| Ex. 23 | 0 | Aragonite | 2.0 | 10.0 | 75 | 25 | Calcium chloride | 25.6 |
| Ex. 24 | 0 | Aragonite | 2.0 | 10.0 | 40 | 60 | Calcium chloride | 25.6 |

| | Cationic resin | | Coating weight | Offset | Ink jet printing | | | |
|---|---|---|---|---|---|---|---|---|
| | | | | | Dye inks | | Pigmented inks | |
| | Type | Parts by mass | (per side) g/m$^2$ | print-ability | Ink fixing properties | Sharp-ness | Ink fixing properties | Rubbing resistance |
| Ex. 13 | Dimethylamine-epichlorohydrin polycondensate | 5.7 | 4.5 | 4 | 4 | 4 | 3 | 3 |
| Ex. 14 | Dimethylamine-epichlorohydrin polycondensate | 4.1 | 4.5 | 3 | 3 | 4 | 4 | 3 |
| Ex. 15 | Dimethylamine-epichlorohydrin polycondensate | 4.1 | 4.5 | 4 | 3 | 4 | 4 | 4 |
| Ex. 16 | Dimethylamine-epichlorohydrin polycondensate | 4.1 | 4.5 | 5 | 4 | 5 | 5 | 5 |
| Ex. 17 | Dimethylamine-epichlorohydrin polycondensate | 4.1 | 4.5 | 3 | 3 | 4 | 4 | 3 |
| Ex. 18 | Dimethylamine-epichlorohydrin polycondensate | 4.1 | 4.5 | 4 | 4 | 5 | 4 | 4 |

TABLE 2-continued

| | | | | | | | | |
|---|---|---|---|---|---|---|---|---|
| Ex. 19 | Dimethylamine-epichlorohydrin polycondensate | 4.1 | 4.5 | 4 | 4 | 5 | 5 | 5 |
| Ex. 20 | Dimethylamine-epichlorohydrin polycondensate | 4.1 | 4.5 | 4 | 4 | 4 | 4 | 4 |
| Ex. 21 | Dimethylamine-epichlorohydrin polycondensate | 4.1 | 4.5 | 4 | 4 | 4 | 4 | 4 |
| Ex. 22 | Dimethylamine-epichlorohydrin polycondensate | 4.1 | 4.5 | 5 | 5 | 5 | 5 | 5 |
| Ex. 23 | Dimethylamine-epichlorohydrin polycondensate | 4.1 | 4.5 | 5 | 5 | 5 | 5 | 5 |
| Ex. 24 | Dimethylamine-epichlorohydrin polycondensate | 4.1 | 4.5 | 5 | 4 | 5 | 5 | 5 |

TABLE 3

| | Pigments | | | | | | | |
|---|---|---|---|---|---|---|---|---|
| | | Precipitated calcium carbonate | | | | | | |
| | Ground calcium carbonate | | Longer | Longer diameter/ shorter | | Kaolin | Water-soluble cation salt | |
| | Parts by mass | Type of crystal | diameter μm | diameter ratio | Parts by mass | Parts by mass | Type | Parts by mass |
| Ex. 25 | 0 | Aragonite | 1.5 | 15.0 | 100 | 0 | Calcium chloride | 25.6 |
| Ex. 26 | 0 | Aragonite | 4.0 | 10.0 | 100 | 0 | Calcium chloride | 25.6 |
| Ex. 27 | 0 | Aragonite | 4.0 | 20.0 | 100 | 0 | Calcium chloride | 25.6 |
| Ex. 28 | 0 | Aragonite | 4.0 | 8.0 | 100 | 0 | Calcium chloride | 25.6 |
| Ex. 29 | 0 | Aragonite | 5.0 | 10.0 | 100 | 0 | Calcium chloride | 25.6 |
| Ex. 30 | 0 | Aragonite | 1.2 | 12.0 | 100 | 0 | Calcium chloride | 25.6 |
| Ex. 31 | 0 | Aragonite | 2.5 | 25.0 | 100 | 0 | Calcium chloride | 25.6 |
| Ex. 32 | 0 | Aragonite | 2.0 | 6.7 | 100 | 0 | Calcium chloride | 25.6 |
| Ex. 33 | 0 | Aragonite | 2.0 | 10.0 | 100 | 0 | Calcium nitrate | 25.6 |
| Ex. 34 | 100 | — | — | — | 0 | 0 | Calcium nitrate | 9.0 |
| Ex. 35 | 100 | — | — | — | 0 | 0 | Calcium nitrate | 9.4 |
| Ex. 36 | 0 | Aragonite | 2.0 | 10.0 | 100 | 0 | Calcium chloride | 25.6 |

| | Cationic resin | | Coating weight | Offset | Ink jet printing | | | |
|---|---|---|---|---|---|---|---|---|
| | | | | | Dye inks | | Pigmented inks | |
| | Type | Parts by mass | (per side) g/m$^2$ | print-ability | Ink fixing properties | Sharp-ness | Ink fixing properties | Rubbing resistance |
| Ex. 25 | Dimethylamine-epichlorohydrin polycondensate | 4.1 | 4.5 | 5 | 5 | 5 | 5 | 5 |
| Ex. 26 | Dimethylamine-epichlorohydrin polycondensate | 4.1 | 4.5 | 5 | 5 | 5 | 5 | 5 |
| Ex. 27 | Dimethylamine-epichlorohydrin polycondensate | 4.1 | 4.5 | 5 | 5 | 5 | 5 | 5 |
| Ex. 28 | Dimethylamine-epichlorohydrin polycondensate | 4.1 | 4.5 | 5 | 5 | 5 | 5 | 5 |
| Ex. 29 | Dimethylamine-epichlorohydrin polycondensate | 4.1 | 4.5 | 4 | 4 | 5 | 4 | 4 |
| Ex. 30 | Dimethylamine-epichlorohydrin polycondensate | 4.1 | 4.5 | 4 | 4 | 5 | 4 | 4 |
| Ex. 31 | Dimethylamine-epichlorohydrin polycondensate | 4.1 | 4.5 | 4 | 3 | 4 | 4 | 4 |
| Ex. 32 | Dimethylamine-epichlorohydrin polycondensate | 4.1 | 4.5 | 4 | 3 | 4 | 4 | 4 |

TABLE 3-continued

| | | | | | | | | |
|---|---|---|---|---|---|---|---|---|
| Ex. 33 | Dimethylamine-epichlorohydrin polycondensate | 4.1 | 4.5 | 5 | 5 | 5 | 5 | 5 |
| Ex. 34 | Dimethylamine-epichlorohydrin polycondensate | 4.4 | 4.5 | 5 | 3 | 5 | 4 | 3 |
| Ex. 35 | Dimethylamine-epichlorohydrin polycondensate | 8.6 | 4.5 | 5 | 3 | 5 | 3 | 5 |
| Ex. 36 | Dimethylamine-epichlorohydrin polycondensate | 4.1 | 4.5 | 5 | 5 | 5 | 5 | 5 |

TABLE 4

| | Pigments | | | | | | | |
|---|---|---|---|---|---|---|---|---|
| | | Precipitated calcium carbonate | | | | | | |
| | Ground calcium carbonate | | Longer | Longer diameter/ shorter | | Kaolin | Water-soluble cation salt | |
| | Parts by mass | Type of crystal | diameter μm | diameter ratio | Parts by mass | Parts by mass | Type | Parts by mass |
| Comp. Ex. 1 | 100 | — | — | — | 0 | 0 | Calcium chloride | 8.8 |
| Comp. Ex. 2 | 100 | — | — | — | 0 | 0 | Calcium chloride | 25.6 |
| Comp. Ex. 3 | 100 | — | — | — | 0 | 0 | Calcium chloride | 35.7 |
| Comp. Ex. 4 | 100 | — | — | — | 0 | 0 | Calcium nitrate | 10.0 |
| Comp. Ex. 5 | 100 | — | — | — | 0 | 0 | Calcium nitrate | 25.6 |
| Comp. Ex. 6 | 100 | — | — | — | 0 | 0 | Calcium chloride | 7.5 |
| Comp. Ex. 7 | 100 | — | — | — | 0 | 0 | Calcium chloride | 41.0 |
| Comp. Ex. 8 | 100 | — | — | — | 0 | 0 | Sodium chloride | 8.8 |
| Comp. Ex. 9 | 100 | — | — | — | 0 | 0 | Sodium chloride | 25.6 |
| Comp. Ex. 10 | 100 | — | — | — | 0 | 0 | Sodium chloride | 35.7 |
| Comp. Ex. 11 | 100 | — | — | — | 0 | 0 | Calcium chloride | 8.8 |
| Comp. Ex. 12 | 100 | — | — | — | 0 | 0 | Calcium chloride | 25.6 |
| Comp. Ex. 13 | 0 | Aragonite | 2.0 | 10.0 | 100 | 0 | Calcium chloride | 25.6 |
| Comp. Ex. 14 | 100 | — | — | — | 0 | 0 | Calcium chloride | 0.0 |

| | Cationic resin | | Coating weight | Offset | Ink jet printing | | | |
|---|---|---|---|---|---|---|---|---|
| | | | | | Dye inks | | Pigmented inks | |
| | Type | Parts by mass | (per side) $g/m^2$ | print-ability | Ink fixing properties | Sharp-ness | Ink fixing properties | Rubbing resistance |
| Comp. Ex. 1 | Dimethylamine-epichlorohydrin polycondensate | 1.0 | 4.5 | 5 | 4 | 2 | 5 | 4 |
| Comp. Ex. 2 | Dimethylamine-epichlorohydrin polycondensate | 3.0 | 4.5 | 5 | 4 | 2 | 5 | 5 |
| Comp. Ex. 3 | Dimethylamine-epichlorohydrin polycondensate | 5.0 | 4.5 | 5 | 4 | 2 | 5 | 5 |
| Comp. Ex. 4 | Dimethylamine-epichlorohydrin polycondensate | 11.0 | 4.5 | 5 | 2 | 5 | 2 | 5 |
| Comp. Ex. 5 | Dimethylamine-epichlorohydrin polycondensate | 28.2 | 4.5 | 5 | 2 | 5 | 2 | 5 |

TABLE 4-continued

| | | | | | | | | |
|---|---|---|---|---|---|---|---|---|
| Comp. Ex. 6 | Dimethylamine-epichlorohydrin polycondensate | 5.7 | 4.5 | 5 | 4 | 5 | 5 | 2 |
| Comp. Ex. 7 | Dimethylamine-epichlorohydrin polycondensate | 6.5 | 4.5 | 5 | 3 | 1 | 5 | 4 |
| Comp. Ex. 8 | Dimethylamine-epichlorohydrin polycondensate | 1.4 | 4.5 | 5 | 2 | 2 | 2 | 1 |
| Comp. Ex. 9 | Dimethylamine-epichlorohydrin polycondensate | 4.1 | 4.5 | 5 | 2 | 2 | 2 | 1 |
| Comp. Ex. 10 | Dimethylamine-epichlorohydrin polycondensate | 5.7 | 4.5 | 5 | 2 | 2 | 2 | 1 |
| Comp. Ex. 11 | — | 0.0 | 4.5 | 5 | 4 | 2 | 5 | 5 |
| Comp. Ex. 12 | Melamine/urea/benzoguanamine amino resin | 4.1 | 4.5 | 3 | 3 | 3 | 5 | 5 |
| Comp. Ex. 13 | Melamine/urea/benzoguanamine amino resin | 4.1 | 4.5 | 3 | 3 | 3 | 5 | 5 |
| Comp. Ex. 14 | Dimethylamine-epichlorohydrin polycondensate | 1.4 | 4.5 | 5 | 4 | 2 | 5 | 1 |

In Examples and Comparative Examples, lightweight coated papers were prepared in the following manner.

<Preparation of Lightweight Coated Papers>

The coating color was applied onto both sides of the base paper using a film transfer coater. The coating weights per side of the base paper are described in Tables 1 to 4. After the coating color was dried, the base paper was calendered on both sides to give lightweight coated paper.

The calendering of the base paper involved a device having an elastic roll and a metal roll. In the calendering treatment, the linear nip pressure was 80 kN/m and the metal roll temperature was 40° C. to ensure an appropriate thickness profile in the width direction.

The lightweight coated papers of Examples 1 to 36 and Comparative Examples 1 to 14 were tested by the following methods to evaluate properties. The results are described in Tables 1 to 4.

<Offset Printability>

Images were printed over a length of 6000 m with an offset form rotary press manufactured by Miyakoshi Printing Machinery Co., Ltd. under printing conditions where the printing speed was 150 m/min, the inks used were T&K TOKA UV BEST CURE black and bronze-red, and 8 kW of UV light was applied from two irradiators. With respect to the printed lightweight coated paper, the occurrence of blanket piling and the quality of the print sample were visually evaluated. Offset printability was evaluated based on the following 5-point scale. In the invention, "having offset printability" means that the rating is any of 3, 4 and 5.

5: Very mod

4: Good

3: Practically usable

2: Bad

1: Very bad

<Dye Ink Fixing Properties>

Images were printed with ink jet printing machine New MJP-600 (type: MJP-20C) manufactured by Miyakoshi Printing Machinery Co., Ltd. The printing conditions were such that the printing speed was 150 m/min and dye inks were used. The images printed for evaluation were color-mixing halftone dot images in which 50% halftone dot patterns of black, cyan, magenta and yellow inks were superimposed in the same area. In this case, the mixing of the colors resulted in black. The lightweight coated paper ejected from the printing machine to the output tray was visually inspected for any defects such as smudges or contaminations of the image and uneven drying of the inks to evaluate ink fixing properties based on the following 5-point scale. In the invention, "having excellent ink fixing properties" for dye inks means that the rating is any of 3, 4 and 5.

5: The image was free from smudges or uneven drying.

4: The image was substantially free from smudges or uneven drying.

3: The image had slight smudges or uneven drying.

2: The image had smudges or uneven drying locally.

1: The image had smudges or uneven drying in its entirety.

<Sharpness of Dye Inks>

Images were printed with ink jet printing machine New MJP-600 (type: MJP-20C) manufactured by Miyakoshi Printing Machinery Co., Ltd. The printing conditions were such that the printing speed was 150 m/min and dye inks were used. The image printed for evaluation was a single continuous row of 2 cm×2 cm square patterns in seven colors, namely, black, cyan, magenta, yellow and secondary colors (red, green and blue) created by a combination of the above color inks except black. The printed images were visually observed to evaluate the patterns of the respective colors and the boundaries based on the following 5-point scale. In the invention, "excellent sharpness" of dye inks means that the rating is 4 or 5.

5: The boundaries between colors were free from bleeding.

4: The boundaries between colors were substantially free from bleeding.

3: A boundary between colors had bled but was still clearly recognizable.

2: A boundary between colors was unclear, and adjacent colors had spread slightly across the boundary.

1: A. boundary between colors was indistinct, and adjacent colors had spread across the boundary to a great extent.

<Pigmented Ink Fixing Properties>

Images were printed with ink jet printing machine Versamark VL2000 manufactured by Eastman Kodak Company. The printing conditions were such that the printing speed was 75 m/min and pigmented inks were used. The images printed for evaluation were single-color 50% halftone dot patterns and characters in black, cyan, magenta and yellow colors. The lightweight coated paper ejected from the printing machine to the output tray was visually inspected for any smudges on the image and uneven drying of the inks to evaluate ink fixing properties based on the following 5-point scale. In the invention, "having excellent fixing properties" for pigmented inks means that the rating is any of 3, 4 and 5.

5: The image was free from smudges or uneven drying.

4: The image was substantially free from smudges or uneven drying.

3: The image had slight smudges or uneven drying.

2: The image had smudges or uneven drying locally.

1: The image had smudges or uneven drying in its entirety.

<Rubbing Resistance of Pigmented Inks>

A black ink was printed with ink jet printing machine Versamark VL2000 manufactured by Eastman Kodak Company to create an 18 cm×18 cm single-color pattern. The printing conditions were such that the printing speed was 75 m/min and the ink was a pigmented ink. After 24 hours after the printing, the single-color pattern was subjected to a rubbing test. In detail, cotton gauze was pressed against the pattern with a load of 500 g or 300 g, and the rubbing resistance of the pigmented ink was evaluated based on the following 5-point scale. In the invention, "excellent rubbing resistance" of pigmented inks means that the rating is any of 3, 4 and 5.

5: The image was not substantially scratched under a load of 500 g.

4: The image was slightly scratched under a load of 500 g within an acceptable level.

3: The image was slightly scratched under a load of 300 g within an acceptable level.

2: The image was scratched under a load of 300 g.

1: The image was markedly scratched under a load of 300 g.

The results described in Tables 1 to 4 show that the lightweight coated papers of Examples 1 to 36 exhibited good offset printability. Further, the lightweight coated papers of Examples 1 to 36 have been illustrated to have good printability in ink jet printing with both aqueous dye inks and aqueous pigmented inks.

On the other hand, Comparative Examples 1 to 14 outside the scope of the invention failed to achieve these good results.

The comparison between. Examples 1, 3, 4 and 5 to 10 and Examples 11 to 13 shows that calcium salts are preferable, and calcium chloride or calcium nitrate is particularly preferable.

The results of Examples 18 to 33 have demonstrated that it is preferable that the coating layer at least contain, as the pigment, aragonite precipitated calcium carbonate having a longer diameter of 1.5 μm to 4 μm and a longer diameter/shorter diameter ratio of 8 to 20, and the content of the aragonite precipitated calcium carbonate in the coating layer be not less than 40 mass % per side of the base paper relative to the total amount of the pigment(s) present in the coating layer. This can be said because the lightweight coated papers of Examples 18 to 33 achieved excellent offset printability, ink fixing properties in ink jet printing; sharpness of dye inks, and rubbing resistance of pigmented inks.

By the use of the inventive lightweight coated papers and an ink jet printing machine having a printing speed of 60 m/min or above, it becomes possible to produce prints having excellent sharpness of dye inks and high rubbing resistance of pigmented inks.

The invention claimed is:

1. Lightweight coated paper comprising:

base paper, and one or more coating layers disposed on at least one side of the base paper, the coating layer including a pigment and a binder, the total coating weight of the coating layer(s) being not more than 7.5 g/m$^2$ per side of the base paper, the coating layer containing a polycondensate of an aliphatic monoamine or an aliphatic polyamine and an epihalohydrin compound, and a water-soluble polyvalent cation salt, the content of the water-soluble polyvalent cation salt in the coating layer being 0.3 g/m$^2$ to 1.0 g/m$^2$ per side of the base paper, the content of the polycondensate of an aliphatic monoamine or an aliphatic polyamine and an epihalohydrin compound in the coating layer being 15 mass % to less than 100 mass % relative to the content of the water-soluble polyvalent cation salt.

2. The lightweight coated paper according to claim 1, wherein the coating layer at least contains, as the pigment, aragonite precipitated calcium carbonate having a longer diameter of 1.5 μm to 4 μm and a longer diameter/shorter diameter ratio of 8 to 20, and the content of the aragonite precipitated calcium carbonate in the coating layer is not less than 40 mass % per side of the base paper relative to the total amount of the pigment(s) present in the coating layer.

3. A print production method comprising a step of printing an ink on the lightweight coated paper described in claim 2 with an ink jet printing machine at a printing speed of not less than 60 m/min.

4. A print production method comprising a step of printing an ink on the lightweight coated paper described in claim 1 with an ink jet printing machine at a printing speed of not less than 60 m/min.

5. Lightweight coated paper comprising:

base paper, and one or more coating layers disposed on at least one side of the base paper, the coating layer including a pigment and a binder, the total coating weight of the coating layer(s) being not more than 7.5 g/m$^2$ per side of the base paper, the coating layer containing a polycondensate of an aliphatic monoamine or an aliphatic polyamine and an epihalohydrin compound, and a water-soluble calcium salt, the content of the water-soluble calcium salt in the coating layer being 0.3 g/m$^2$ to 1.0 g/m$^2$ per side of the base paper, the content of the polycondensate of an aliphatic monoamine or an aliphatic polyamine and an epihalohydrin compound in the coating layer being 15 mass % to less than 100 mass % relative to the content of the water-soluble calcium salt.

6. The lightweight coated paper according to claim 2, wherein the coating layer at least contains, as the pigment, aragonite precipitated calcium carbonate having a longer diameter of 1.5 μm to 4 μm and a longer diameter/shorter diameter ratio of 8 to 20, and the content of the aragonite precipitated calcium carbonate in the coating layer is not less than 40 mass % per side of the base paper relative to the total amount of the pigment(s) present in the coating layer.

7. A print production method comprising a step of printing an ink on the lightweight coated paper described in claim 5 with an ink jet printing machine at a printing speed of not less than 60 m/min.

8. Lightweight coated paper comprising:

base paper, and one or more coating layers disposed on at least one side of the base paper, the coating layer including a pigment and a binder, the total coating weight of the coating layer(s) being not more than 7.5 $g/m^2$ per side of the base paper, the coating layer containing a polycondensate of an aliphatic monoamine or an aliphatic polyamine and an epihalohydrin compound, and calcium chloride or calcium nitrate, the content of the calcium chloride or calcium nitrate in the coating layer being 0.3 $g/m^2$ to 1.0 $g/m^2$ per side of the base paper, the content of the polycondensate of an aliphatic monoamine or an aliphatic polyamine and an epihalohydrin compound in the coating layer being 15 mass % to less than 100 mass % relative to the content of the calcium chloride or calcium nitrate.

9. The lightweight coated paper according to claim 8, wherein the coating layer at least contains, as the pigment, aragonite precipitated calcium carbonate having a longer diameter of 1.5 μm to 4 μm and a longer diameter/shorter diameter ratio of 8 to 20, and the content of the aragonite precipitated calcium carbonate in the coating layer is not less than 40 mass % per side of the base paper relative to the total amount of the pigment(s) present in the coating layer.

10. A print production method comprising a step of printing an ink on the lightweight coated paper described in claim 8 with an ink jet printing machine at a printing speed of not less than 60 m/min.

* * * * *